US007457756B1

(12) United States Patent
Nelson et al.

(10) Patent No.: US 7,457,756 B1
(45) Date of Patent: Nov. 25, 2008

(54) METHOD OF GENERATING TIME-FREQUENCY SIGNAL REPRESENTATION PRESERVING PHASE INFORMATION

(75) Inventors: Douglas J. Nelson, Columbia, MD (US); David Charles Smith, Columbia, MD (US)

(73) Assignee: The United States of America as represented by the Director of the National Security Agency, Washington, DC (US)

( * ) Notice: Subject to any disclaimer, the term of this patent is extended or adjusted under 35 U.S.C. 154(b) by 617 days.

(21) Appl. No.: 11/149,005

(22) Filed: Jun. 9, 2005

(51) Int. Cl.
*G10L 19/02* (2006.01)
*G10L 21/06* (2006.01)

(52) U.S. Cl. ..... 704/276; 704/205; 704/211; 704/226; 704/235

(58) Field of Classification Search ..... 704/201, 704/237, E21.004, 205, 211, 226, 276
See application file for complete search history.

(56) References Cited

U.S. PATENT DOCUMENTS

| | | | | |
|---|---|---|---|---|
| 5,574,639 | A * | 11/1996 | Qian et al. | 708/300 |
| 5,910,905 | A * | 6/1999 | Qian et al. | 708/311 |
| 6,324,487 | B1 * | 11/2001 | Qian et al. | 702/147 |
| 6,434,515 | B1 | 8/2002 | Qian | |
| 7,085,721 | B1 * | 8/2006 | Kawahara et al. | 704/258 |
| 2002/0183948 | A1 * | 12/2002 | Qian et al. | 702/75 |
| 2004/0136544 | A1 * | 7/2004 | Balan et al. | 381/94.7 |
| 2005/0010397 | A1 * | 1/2005 | Sakurai et al. | 704/205 |
| 2005/0114128 | A1 * | 5/2005 | Hetherington et al. | 704/233 |
| 2005/0283360 | A1 * | 12/2005 | Large | 704/205 |
| 2006/0229878 | A1 * | 10/2006 | Scheirer | 704/273 |
| 2007/0030002 | A1 * | 2/2007 | Frei et al. | 324/309 |
| 2007/0271319 | A1 * | 11/2007 | Smith | 708/201 |

FOREIGN PATENT DOCUMENTS

| | | | |
|---|---|---|---|
| EP | 822538 | A1 * | 2/1998 |
| EP | 828239 | A2 * | 3/1998 |
| JP | 2001228187 | A * | 8/2001 |

OTHER PUBLICATIONS

Nelson, "Cross-spectral methods for processing speech." The Journal of the Acoustical Society of America, 2001.*

Kawahara, H., Masuda-Katsuse, I., and de Cheveigne', A. ~1999. "Restructuring speech representations using a pitch-adaptive time-frequency smoothing and an instantaneous-frequency-based F0 extraction: Possible role of a repetitive structure in sounds," Speech Commun. 27, 187-207.*

F. Plante, G. Meyer, and W. A. Ainsworth, "Improvement or speech spectrogram accuracy by the method of spectral reassignment," IEEE Transactions on Speech and Audio Processing, vol. 6, No. 3, pp. 282-287, May 1998.*

* cited by examiner

*Primary Examiner*—Talivaldis Ivars Smits
*Assistant Examiner*—Edgar Guerra-Erazo
(74) *Attorney, Agent, or Firm*—Robert D. Morelli

(57) ABSTRACT

A method of generating a time-frequency representation of a signal that preserves phase information by receiving the signal, calculating a joint time-frequency domain of the signal, estimating instantaneous frequencies of the joint time-frequency domain, modifying each estimated instantaneous frequency, if necessary, to correspond to a frequency of the joint time-frequency domain to which it most closely compares, redistributing the elements within the joint time-frequency domain according to the estimated instantaneous frequencies as modified, computing a magnitude for each element in the joint time-frequency domain as redistributed, and plotting the results as the time-frequency representation of the signal.

9 Claims, 1 Drawing Sheet

METHOD OF GENERATING TIME-FREQUENCY SIGNAL REPRESENTATION PRESERVING PHASE INFORMATION

FIELD OF INVENTION

The present invention relates, in general, to speech signal processing and, in particular, to generating a time-frequency representation of a signal that preserves phase information.

BACKGROUND OF THE INVENTION

A frequently recurring problem in communications is the need to accurately represent the spectrum a signal in order to perform various signal processing techniques on the signal (e.g., remove noise and interference). Cross terms in a signal make it difficult for prior art time-frequency methods to isolate individual components in the signal.

Prior art time-frequency methods describe the density of a signal's energy as a joint function of time and frequency, and frequently make two assumptions: (1) density is nonnegative and (2) what are the energy marginal conditions. The energy marginal conditions require that the integral of the time-frequency density with respect to frequency (time) for fixed time (frequency) equals the magnitude square of the signal (signal's Fourier transform) at time (frequency).

Mapping from signals to their conventional time-frequency densities (surfaces) is not linear, since the marginal conditions are not linear. That is, the magnitude square of the sum of the two signals (signals' Fourier transforms) is not the sum of the magnitudes of the individual signals (signal's Fourier transforms). Consequently, enforcing the energy marginal conditions for a multi-component signal requires that additional cross-term energy, not present in the time-frequency densities of individual components, must be spread over the time-frequency surface of the composite signal. This makes it difficult, if not impossible to use conventional time-frequency methods to generate a time-frequency representation of the individual components of a multi-component signal.

Many of the problems associated with prior art time-frequency methods may result from distributing a non-linear quantity. The basis for this is that while signals add, their corresponding energies do not. The present invention overcomes the problem associated with the prior art time-frequency methods.

U.S. Pat. No. 6,434,515, entitled "SIGNAL ANALYZER SYSTEM AND METHOD FOR COMPUTING A FAST GABOR SPECTROGRAM," discloses a method of computing a time-varying spectrum of an input signal using a multi-rate filtering technique. The present invention does not use a multi-rate filtering technique as does U.S. Pat. No. 6,434,515. U.S. Pat. No. 6,434,515 is hereby incorporated by reference into the specification of the present invention.

SUMMARY OF THE INVENTION

It is an object of the present invention to generate a time-frequency representation of a signal.

It is another object of the present invention to generate a time-frequency representation of a signal in a manner that preserves the phase information contained in the signal.

The present invention is a method of generating a time-frequency representation of a signal that preserves the phase information contained in the signal.

The first step of the method is receiving the signal.

The second step of the method is converting the received signal to the joint time-frequency domain.

The third step of the method is estimating an instantaneous frequency (IF) for each element in the joint time-frequency domain calculated in the second step.

The fourth step of the method is modifying each result of the third step, if necessary, where each IF element is replaced, if necessary, with the discrete frequency of the joint time-frequency domain created in the second step to which it most closely compares in value.

The fifth step of the method is redistributing the elements within the joint time-frequency domain created in the second step according to the IF elements as modified by the fourth step.

The sixth step of the method is computing, for each time, the magnitudes of each element of joint time-frequency domain as redistributed in the fifth step.

The seventh, and last, step of the method is plotting the results of the sixth step in a graph as the time-frequency representation of the received signal.

DETAILED DESCRIPTION

Figure 1:
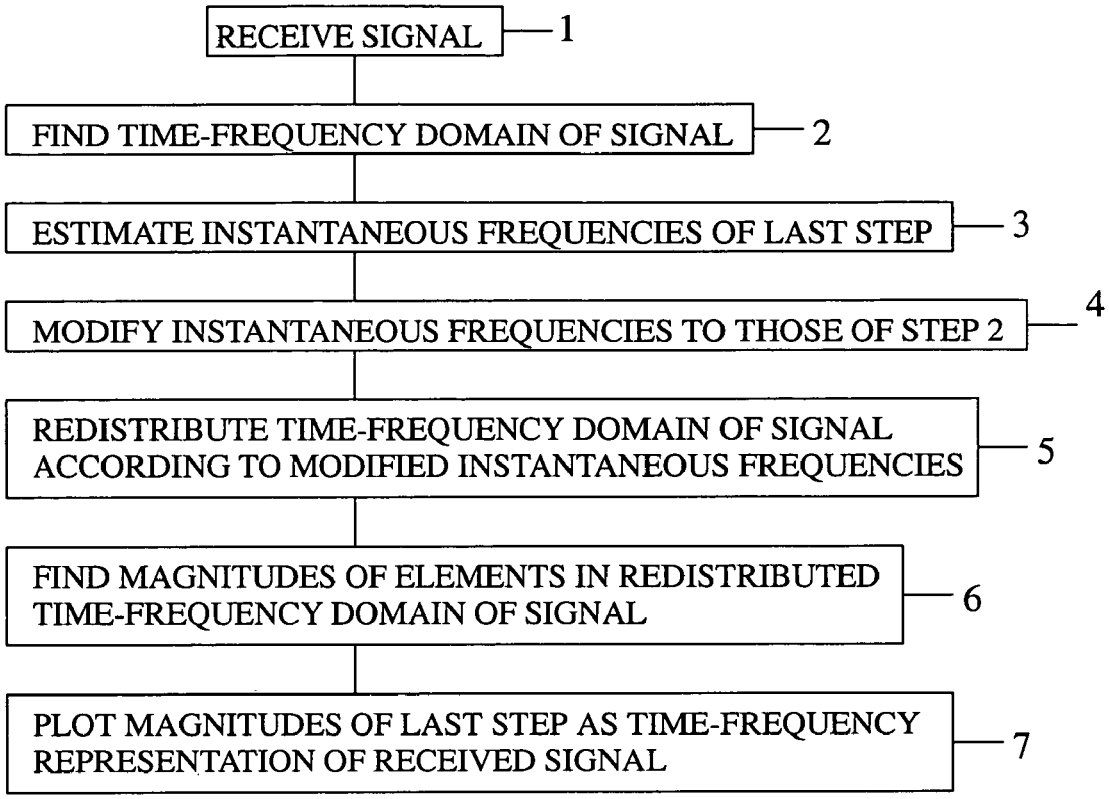
FIG. 1 is a flowchart of the steps of the present invention.

The present invention is a method of generating a time-frequency representation of a signal that preserves the phase information contained in the signal. The present invention is a novel linear time-frequency method, in which the value of a signal at any time is distributed in frequency, rather than the energy of the signal as is done in prior art time-frequency methods. The present method uses instantaneous frequencies to modify a time-frequency domain, and is linear on the span of the signal's components when the components are linearly independent. The present method produces a time-frequency representation in which the value of each signal component is distributed accurately and focused narrowly along the component's instantaneous frequency curve in the time-frequency plane, if the signal contains multiple components that are linearly independent and separable. The present invention more accurately isolates and graphs signal components than does the prior at methods, which blur component location in time-frequency representations.

FIG. 1 is a flowchart of the method of the present invention.

The first step 1 of the method is receiving the signal. The signal may be in the time or frequency domain. In the preferred embodiment, the received signal is in the time domain.

The second step 2 of the method is converting the received signal to the joint time-frequency domain. In the preferred embodiment, the second step 2 is accomplished by calculating a short-time Fourier transform (STFT) on the received speech signal. An STFT is a known method of forming a matrix of complex values that represent the signal, where the columns (or rows) of the matrix are discrete time and the rows (or columns) of the matrix are discrete frequency. The elements of the matrix may be thought of as representing a complex-valued surface. An STFT is computed by selecting a window size, selecting a window-sized portion of the received signal, and performing a Fourier Transform on the selected portion of the signal. Another window is selected and the steps are repeated. In the preferred embodiment, a subsequently selected window overlaps the previously selected window (e.g., all but one sample in the new window is the same as the previous window). Each element of the resulting STFT matrix is of the following form:

$$z=x+iy,$$

Represented in time and frequency, each element of the matrix is of the following form:

$$z(t,\omega)=x(t,\omega)+iy(t,\omega),$$

The representation in time and phase may be represented in polar form as follows:

$$z(t,\omega)=\sqrt{x^2(t,\omega)+y^2(t,\omega)}\times e^{i\phi(t,\omega)},$$

where $\phi(t,\omega)$ is the argument (arg) of the element, and where $$\arg = \tan^{-1}\left(\frac{y(t,\omega)}{x(t,\omega)}\right).$$

The third step 3 of the method is estimating an instantaneous frequency (IF) for each element in the STFT matrix calculated in the second step 2. The result is an IF matrix, where the rows and columns are the same discrete times and frequencies as those of the STFT matrix, and where each IF is located in the IF matrix at the same time and frequency as that of its corresponding STFT element. In the preferred embodiment, the IFs are estimated for the elements of the STFT matrix by finding the argument for each element in the STFT matrix, forming an argument matrix, and calculating the derivative of the argument matrix with respect to time. The result is an IF matrix, where an element in the IF matrix is the IF of the corresponding element in the STFT matrix.

The fourth step 4 of the method is modifying each result of the third step 3, if necessary, where each element in the IF matrix is replaced, if necessary, with the discrete frequency of the STFT matrix created in the second step 2 to which it most closely compares in value. For example, if the discrete frequencies in the STFT matrix are 1 Hz, 2 HZ, . . . , then an IF matrix element of 1.4 Hz would be changed to 1 Hz, while an IF matrix element of 1.6 would be changed to 2 Hz, and an IF matrix element of 2 Hz would not be changed.

The fifth step 5 of the method is redistributing the elements within the STFT matrix created in the second step 2 according to the IF matrix as modified by the fourth step 4 by identifying an STFT matrix element's corresponding element in the IF matrix, determining the value of the corresponding IF matrix element, and moving the STFT matrix element within its column to the row that corresponds to the value of the corresponding IF matrix element. If two elements of the STFT matrix map to the same row then sum those STFT elements and place the result at the row. In the following example, an STFT matrix of complex-valued elements, represented by letters of the alphabet for simplicity, will be remapped according to a modified IF matrix. The columns of the STFT matrix are in time (i.e., 1-4 msecs.), and its rows are in frequency (i.e., 1-4 Hz.). Each element in the modified IF matrix corresponds to a column value in the STFT matrix.

STFT Matrix

| | 1 msec. | 2 msec. | 3 msec. | 4 msec. |
|---|---|---|---|---|
| 1 Hz. | A | E | I | M |
| 2 Hz. | B | F | J | N |
| 3 Hz. | C | G | K | O |
| 4 Hz. | D | H | L | P |

Modified IF Matrix

| | 1 msec. | 2 msec. | 3 msec. | 4 msec. |
|---|---|---|---|---|
| 1 Hz. | 2 | 3 | 2 | 3 |
| 2 Hz. | 4 | 3 | 2 | 3 |
| 3 Hz. | 2 | 1 | 4 | 1 |
| 4 Hz. | 4 | 1 | 4 | 1 |

Remapped STFT Matrix

| | 1 msec. | 2 msec. | 3 msec. | 4 msec. |
|---|---|---|---|---|
| 1 Hz. | | G + H | | O + P |
| 2 Hz. | A + C | | I + J | |
| 3 Hz. | | E + F | | M + N |
| 4 Hz. | B + D | | K + L | |

The result of the fifth step 5 is a novel time-frequency representation. When applied to a multi-component signal which has linearly independent components and which are separable, the method produces a time-frequency representation in which the value of each signal component is distributed, or concentrated, along the component's instantaneous frequency curve in the time-frequency plane. The concentrated STFT is a linear representation, free of cross-terms, which plagued the prior art methods, and having the property that signal and interference components are easily recognized because their distributions are more concentrated in time and frequency. A plot of the remapped matrix is necessary to see that the elements have been so remapped. The following steps result in such a plot.

The sixth step 6 of the method is computing, for each time, the magnitudes of each element in the redistributed STFT matrix of step (e).

The seventh, and last, step 7 of the method is plotting the results of the sixth step 6 in a graph as the time-frequency representation of the received signal, where one axis is time, and the other axis is frequency. The result is a focused representation of each signal component of the received signal, where the phase information of the received signal is retained. Prior art methods do not retain such phase information.

What is claimed is:

1. A method of generating a time-frequency representation of a signal that preserves phase information, comprising the steps of:

a) receiving the signal;

b) calculating a joint time-frequency representation of the received signal that includes elements;

c) estimating instantaneous frequencies of the joint time-frequency domain;

d) modifying each estimated instantaneous frequency, if necessary, to correspond to a frequency of the joint time-frequency domain to which it most closely compares;

e) redistributing the elements within the joint time-frequency domain according to the estimated instantaneous frequencies as modified; and f) computing a magnitude for each element in the joint time-frequency domain as redistributed; and g) plotting the results of step (f) as the time-frequency representation of the received signal.

2. The method of claim 1, wherein the step of receiving a signal, is comprised of receiving a signal, where the signal includes an intended signal, at least one signal component selected from the group of signal components consisting of an interfering signal and noise.

3. The method of claim 1, wherein the step of calculating a joint time-frequency domain of the received signal is comprised of the step of calculating a short-time Fourier Transform of the signal received in step (a), where the result is in matrix form, where the rows and columns represent discrete frequencies and times in a user-definable manner.

4. The method of claim 3, wherein the step of calculating a short-time Fourier Transform is comprised of the step of selecting a window size, selecting a window-sized portion of the received signal, performing a Fourier Transform on the selected portion of the received signal, selecting a next window, where the next window overlaps a user-definable amount with the window selected just prior to the next window, selecting a next portion of the received window in accordance with the next window selected, performing a Fourier Transform on the next portion of the received signal, and repeating these steps until the entire received signal has been processed.

5. The method of claim 3, wherein the step of estimating instantaneous frequencies of the joint time-frequency domain is comprised of the step of estimating instantaneous frequencies of the short-time Fourier Transform calculated in step (b).

6. The method of claim 5, wherein the step of estimating instantaneous frequencies of the short-time Fourier Transform is comprised of the steps of:

(a) determining arguments for each element in the short-time Fourier Transform matrix;

(b) forming an argument matrix from the results of step (a), where each element in the argument matrix corresponds to the element in the short-time Fourier Transform matrix from which the argument was determined;

(c) calculating a derivative of the argument matrix; and (d) forming an instantaneous frequency matrix from the results of step (c), where each element in the instantaneous frequency matrix corresponds to the element in the argument matrix from which the instantaneous frequency matrix element was derived.

7. The method of claim 3, wherein the step of modifying each estimated instantaneous frequency, if necessary, to correspond to a frequency of the joint time-frequency domain calculated in step (b) to which it most closely compares is comprised of the step of modifying each instantaneous frequency, if necessary, to the closest discrete frequency of the short-time Fourier Transform of step (b).

8. The method of claim 3, wherein the step of redistributing the elements within the joint time-frequency domain according to the instantaneous frequencies as modified in step (d) is comprised of the step of redistributing the elements within the short-time Fourier Transform according to the instantaneous frequencies.

9. The method of claim 8, wherein the step of redistributing the elements within the short-time Fourier Transform according to the instantaneous frequencies is comprised of the steps of:

(a) identifying, for each element in the short-time Fourier Transform, the instantaneous frequency that corresponds position-wise to the element in the short-time Fourier Transform;

(b) identifying a value of the identified instantaneous frequency; and (c) moving the corresponding element in the short-time Fourier Transform to a location within its matrix column that corresponds to the identified value of the corresponding instantaneous frequency, summing all of the short-time Fourier Transform elements that map to the same location.

* * * * *